US006312344B1

(12) United States Patent
Smith

(10) Patent No.: US 6,312,344 B1
(45) Date of Patent: Nov. 6, 2001

(54) GOLF TRAINING AID

(76) Inventor: Amy J. Smith, 55 Ocean Lane Dr., #2018, Key Biscayne, FL (US) 33149

( * ) Notice: Subject to any disclaimer, the term of this patent is extended or adjusted under 35 U.S.C. 154(b) by 0 days.

(21) Appl. No.: 09/368,961

(22) Filed: Aug. 5, 1999

(51) Int. Cl.[7] ..... A63B 69/36
(52) U.S. Cl. ..... 473/237
(58) Field of Search ..... 473/237, 224, 473/324, 329, 330, 190; 102/281

(56) References Cited

U.S. PATENT DOCUMENTS

| | | | | |
|---|---|---|---|---|
| 2,998,777 | * | 9/1961 | Ryan | 102/281 |
| 4,170,357 | * | 10/1979 | Greer | 473/329 |
| 5,597,361 | * | 1/1997 | Hope | 473/237 |
| 5,779,556 | * | 7/1998 | Cervantes et al. | 473/237 |
| 5,830,077 | * | 11/1998 | Yavitz | 473/224 |

* cited by examiner

*Primary Examiner*—Mark S. Graham
(74) *Attorney, Agent, or Firm*—Malin, Haley & DiMaggio, P.A.

(57) ABSTRACT

A golf training aid designed to give a golfer a multi-sensory practice experience by providing sound, smell and a visual measure of how the club struck the ball at impact. The invention uses cap strips placed in the club face starting with the largest size and then smaller size as accurate as he improves. The device includes using a thin paper body with an array of tiny explosive charges disposed across the surface that includes an adhesive for attaching the invention to the club face while permitting its removal when the shot has been taken. The golfer can visually determine where the ball impacted the club face after the shot. The golfer also hears an explosion at the time of impact along with a olfactory response from the caps exploding. The golf training aid is very inexpensive to use, and the devices can be saved to see the pattern of hitting from the golfer. The golf training aid does not impact the swing of the golfer in any way from a normal golf swing because it is so tiny and does not measurably change the golf swing at all.

3 Claims, 1 Drawing Sheet

FIG. 1
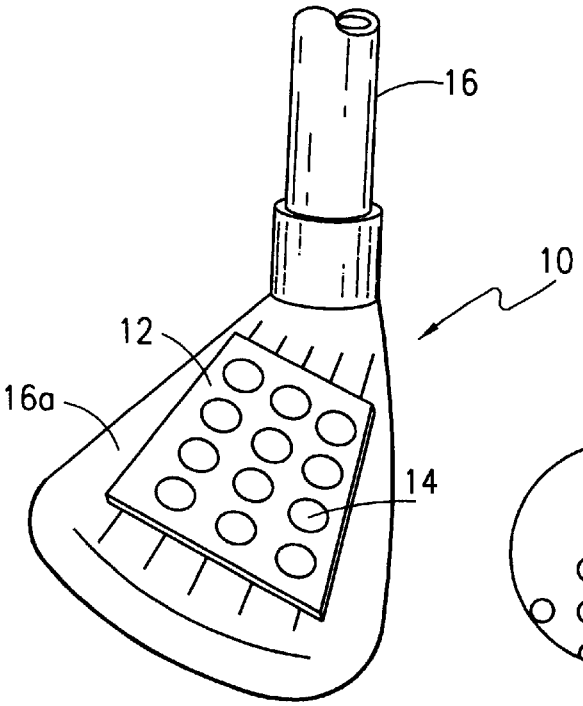
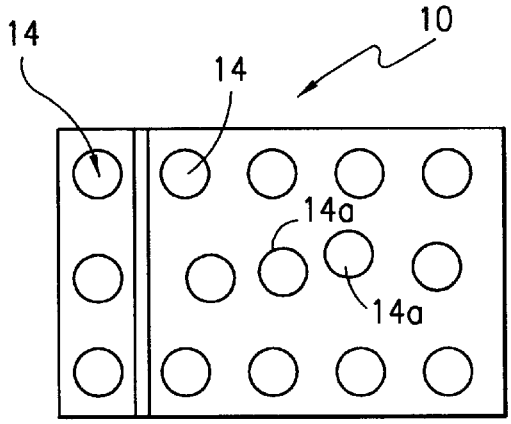
FIG. 2
FIG. 3
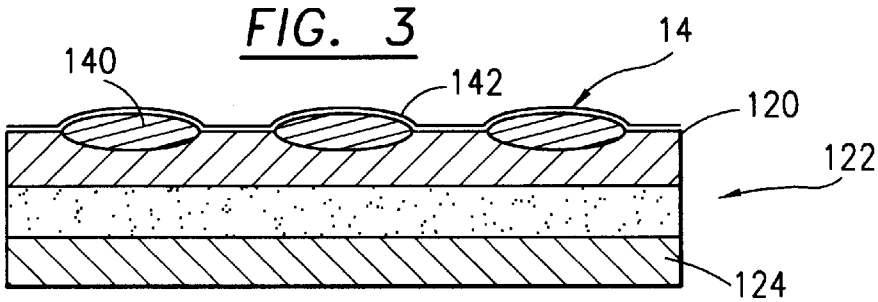
FIG. 4
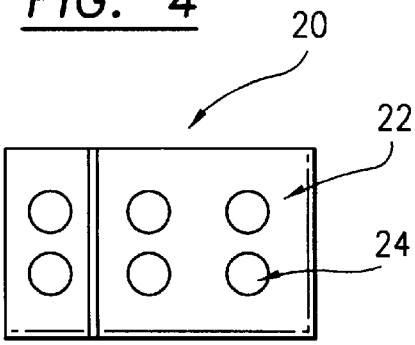

GOLF TRAINING AID

BACKGROUND OF THE INVENTION

1. Field of the Invention

This invention relates generally to a golf training aid for providing a golfer with multi-sensory experience while hitting a golf ball with a golf club and specifically, to an improved golf training aid that can provide to the golfer audio sensory and olfactory responses at impact between a golf club head and the ball and provide an indication whereabouts across the golf head face the ball actually struck the club face for training purposes.

2. Description of Related Art

Numerous devices have been tried over the years in the endless pursuit of hitting a golf ball with the perfect swing. While many variables are present in obtaining the perfect golf swing and golf club head velocity for improved distance, in the final analysis, the moment of truth is the moment that the club head face actually impacts the ball. This moment is typically at the dynamic maximum position of the swing.

Because of the relative quickness of the many different variables going on during the swing, it is hard to really appreciate the actual dynamics and variables from the back swing down to club impact.

The purpose of the present invention is to allow a golfer to utilize the golfer's own sensory perception, such as sight, hearing and olfactory combined together at the moment of impact for sensory feedback at the moment of impact. This will allow the golfer's mental perceptions to be alerted at the moment of impact through the use of the present invention.

Another training objective would be to find out where the ball actually engaged the club face during the golf swing at the moment of impact. The present invention also provides for a visually inspectable, graphic pattern that shows the location of the ball impact on the club face. This information can be very helpful to the golfer in adjusting the golfer's stance, swing, or grip.

BRIEF SUMMARY OF THE INVENTION

A golfer's training aid to provide audio, visual and olfactory sensory stimulation at club impact in a visual record of ball impact on the face of the club comprising a paper sheet sized to fit approximately on the club face of a golf club, such as a driver, or slightly smaller, the outside periphery being shaped to cover the golf face, said thin sheet body including one or more impact explosive charges arranged in a predetermined matrix or array across the sheet body and across the club face, said explosive charges being encapsulated in another thin sheet and separated by predetermined amounts to form the array, such that individual explosive charges are provided that will not interfere or cause an adjacent charge to explode without impact.

The sheet body holding the array of explosive charges will include a suitable adhesive on one side of the sheet so that it can be firmly affixed to the face of a golf club, but at the same time, not be impossible to remove once the charges have been dissipated through impact. Each of the charges may have their own individual shape in the array, such as circular, and may be approximately ¼ of an inch in diameter and spaced a ¼ of an inch apart. The array could be in a matrix, such as rectangular rows, the circular charges disposed across the entire face of the sheet and thereby covering the entire face of the golf club.

Suitable explosive charges could be employed that were conventionally known as "caps" and were used several years ago in toy guns called cap guns in which a row of paper-mounted, small explosive charges covered by paper, could be inserted in the cap gun and individually fired by the impact of the toy gun hammer against the cap or explosive charge as it came up through a fake hammer and gun.

To operate the invention, a golf club, such as an iron or driver, is selected. A thin body sheet containing the array of charges may have a protective cover to protect the adhesive until time of use. The cover sheet can than be peeled away and the charge array sheet body affixed to the club face with the adhesive. The body sheet will be of predetermined shapes for different clubs, such as drivers, and different shapes across the face of the club for irons. Once the sheet is attached to the club face, then the golfer would address the ball in a normal way and proceed to drive the golf ball.

At impact, when the ball engages the face of the club during the drive, it can be appreciated that the velocity of the club face and momentum, as it strikes the ball, will cause the ball to severely impact the club face. The explosive charges on the matrix array of charges on the club face will then be exploded if they directly impact the ball and contact the ball during impact. At the moment of impact, the explosive charges that do contact the ball will explode if they contact it directly enough causing a loud bang or bangs from each of the explosive charges, while at the same time, the driver's looking downward and hears the charge and will also get an olfactory or smell of the charge being exploded. Thus, at the impact, while we are looking directly at the ball, there will be a definite banging noise and olfactory response.

Once the drive is completed, the golfer than can also visually inspect and remove the thin sheet with the array of charges and note the charges that have exploded which will indicate what part of the club face the ball actually was positioned at the moment of impact. Several important lessons or training aids can be gleaned from such a visual inspection, especially whether the golfer was hitting the ball at the proper area on the club face, the club face angle too far inside or too far outside to determine a certain specific flaw in the golfer's impact swing. The golfer can also write on the back of the sheet the date, what type of hit, and accumulate a plurality of the explosive matrix arrays to show the changes or improvements in the golf swing during drives. Also, the same procedure can be used for different iron shots, so that the golfer could accumulate the matrix sheets for different clubs and write that on the sheets. Often time, a golfer may master one club, such as a driver, while at the same time, have problems with different irons.

The sheet material itself will be preferably made of paper with the explosive charges being mounted thereon, much like caps discussed above, and themselves, which are coated by a thin paper sheet. Although the matrix array of explosive charges can vary in size, shape and geometric pattern, it is desired to have several small charges closely spaced together to give the greatest visual information of high accuracy of specific location on the club face that the ball impacted the club face. Thus, there could be a higher resolution caused by smaller, closer space dots of explosives depending on the resolution and accuracy desired.

It is believed that the impact could also include a louder noise if it is done correctly, because more explosive charges would be fired giving more audio feedback to the golfer when the swing is just right. This allows for reinforcement in the training process.

The invention could be constructed in large sheets of paper or plastic or precut kits of proper size, or suitable for providing for the explosive charge in the matrix array that could be cut with a scissors to fit perfectly on different club faces or as precut kits specifically for drivers and specifically for irons. Thus, the sheet form could be delineated or cut to adjust to the correct area size. Some golfers may prefer to place a small explosive charge area in the center of the "sweet spot" of the club to listen for the impact, if the shot is correct.

It is an object of this invention to provide an improved golf training aid that during a golf swing, at the moment of club face impact with the ball, multiple sensory perceptions will be available to the golfer.

And yet another object of this invention is to provide an improved golf training aid that includes audio, visual and olfactory sensory perceptions at the moment of ball impact with a golf club.

And yet still another object of this invention is to provide a golf training aid for a golf club that can give a visual pattern that can be stored of information showing the specific location of where the golf ball impacted the club face during the golf swing to aid in improving the golf swing.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 1 shows a perspective view of a golf club driver with the present invention affixed to the golf club face.

FIG. 2 shows a side elevational view in cross-section of the present invention.

FIG. 3 shows a top plan view of one embodiment of the present invention.

FIG. 4 shows a top plan view of an alternate embodiment of the present invention.

PREFERRED EMBODIMENT OF THE INVENTION

Referring now to the drawings and in particular FIG. 1, the present invention is shown generally at 10 comprised of rectangular, heavy paper body 12 that is attached by adhesive (see FIG. 3) to a golf club iron 16, having a club face 16*a*. The rectangular body 12 has disposed across its surface a matrix or an array individual, explosive impact charges commonly referred to as "caps" which are strategically aligned to provide visual and audio information when the golf club 16, and in particular, the golf club face 16*a* engages a golf ball 18, at the moment of impact. Also olfactory information, the sense of smell will be detected at the same time due to the explosion of one or more caps at impact.

The golfer can utilize the present invention which comes with a protective cover or protective piece of paper on the adhesive that can be removed when it is time to use the device. At that time, the golfer would remove the protective sheet that covers the adhesive and then, based on the club chosen such as an iron 16, the rectangular body 12 is sized to fit on face 16*a* of the golf club such that the golfer would apply rectangular body 12 directly and compress body 12 on the club face 16*a* wherein the adhesive will cause body 12 to stick to the club face. An adhesive is selected such that the caps and rectangular body 12 are firmly attached to the club face but can be removed after the ball is hit. In other words, the paper body 12 can be peeled off of the club face 16*a* after use.

FIG. 2 shows the golf training aid 10, which is a basically body 12 rectangular in shape (although the shape could be somewhat varied depending on the shape of the club face and the amount of area required to be covered on the club face). As shown in FIG. 2, there is a top horizontal row of caps 14, which are permanently attached to the body 12. A second horizontal row of caps 14*a* may be asymmetrically spaced so that closer to the center of the entire body 12, there is a concentration of two caps 14*a* that are disposed adjacent each other near the ideal impact point. This would result in a louder explosion when the caps are ignited if struck in the proper place for greater training impact. Again, the bottom row may be symmetrically disposed relative to each other, spaced apart equally or moved around depending on the desired teaching such as for slices or hooks and that portion of the club face that is most likely to be engaged during those maneuvers. The particular cap array can be in a matrix horizontally and vertically, could be circular or any geometrical design as it relates to training in determining what areas of the golf club face were impacted most by the ball. There could be a very dense covering of caps very close together to show the exact outline of where the ball struck the club face. A glue line separation 126 allows to bend body 12 to peel off the protection adhesive cover discussed below.

FIG. 3 shows the construction of the present invention, which includes a rectangular, sturdy paper body 120, which has mounted on the top a plurality of explosive charges 140 that are covered by a thin paper cover 142, or other suitable covering for the explosive 140. Each of the caps 140 is constructed similarly. The bottom side of paper body 120 includes an adhesive 122 that is used to affix the paper body 120 containing caps 14 to the club face 16*a* shown in FIG. 1. A protective plastic or paper sheet 124 that will allow separation to protect the adhesive 122 when not in use, can be peeled back when it is time to apply the invention to the club face.

FIG. 4 shows an alternate embodiment 20 of the invention, which is smaller and rectangular in size and contains a relatively few number of caps 24 mounted on body 22. This device 20 could be used if just a very small spot on the club face is utilized to determine ball impact for a specific training device. Adhesive is also used to affix device 20 to a club face.

In use, the golfer would peel back the protective paper 124 shown in FIG. 3. The invention 10 would then be affixed to a club face, as desired. The golfer then would address the ball and perform the golfer's normal golf swing. Note that this training aid does not impede in any way the golfer's normal swing, vision or other sensory perceptions of the body, as many golf aids do that are attached to the head, the neck, the arms, and the like. When the ball is impacted by the club face, one or more of caps 14 will be detonated. Thus, at the moment of impact, the golfer will receive an audio alert that is combined with the feel of the swing. The golfer will also smell the cap explosion. Finally, after the swing is complete, the golfer can visually inspect and remove and save the present invention, which will show the exact area on the club face where the ball was struck. Thus, the invention provides a multitude of different sensory and visual perceptions without interfering with the normal golf swing.

Note that although the invention is shown as rectangular and made of a paper body, other embodiments may be possible using other materials other than paper such that the caps could be mounted on a plastic base. Also, the perimeter shape, as shown here as rectangular, could be circular, elliptical or any other shape that will achieve the function of conforming to the golf face while at the same time providing training, as desired.

The present invention is a very inexpensive golf training aid, the results of which can be saved to watch for progress and improvement in the swing and can be done every time someone plays golf without in any way impeding the natural swing.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A golf training aid for use with a golf club having a club face to provide a golfer with a multiple sensory practice experience of providing sound and smell and a visual measure of where the club face strikes the ball at impact comprising:

a golf club having a club face;

a thin sheet of material having length and width and a periphery shaped for attachment to said golf club face, the sheet of material length and width and periphery being sized to occupy a portion of the area of said golf club face;

an explosive charge mounted in predetermined, discrete areas on said sheet of material on one side to constitute a plurality of independent explosive charges occupying a matrix or in predetermined locations on the top side of said of thin sheeted material to provide golf ball impact locations on said club face;

an adhesive mounted on the bottom side of said sheeted material, said adhesive being capable of affixing said sheeted material to the face of a golf club head, said explosive charges being sized and positioned such that when the club face containing the thin sheeted material impacts a golf ball during a golf swing, one or more of said charges will explode providing multiple sensory practice to said golfer at the moment of impact; and said explosive charges are arranged in a predetermined pattern such that more of the explosive charges are located near a desired impact point of said golf club face.

2. A golf training aid as in claim 4, wherein:

said adhesive allows said thin sheeted material to be removed from said golf club face at any time.

3. A golf training aid as in claim 4, including:

a second sheet of thin material sized and shaped to be mounted on the bottom of said adhesive to protect the adhesive from drying up until the device is ready for use wherein the bottom thin sheet may be peeled back readily making the device ready for use.

* * * * *